US007682287B1

(12) United States Patent
Hsieh

(10) Patent No.: US 7,682,287 B1
(45) Date of Patent: Mar. 23, 2010

(54) POWERED STRENGTH TRAINER

(75) Inventor: Li-Min Hsieh, YangMei Township, Taoyuan County (TW)

(73) Assignee: Chi Hua Fitness Co., Ltd., Taoyuan County (TW)

( * ) Notice: Subject to any disclaimer, the term of this patent is extended or adjusted under 35 U.S.C. 154(b) by 0 days.

(21) Appl. No.: 12/385,679

(22) Filed: Apr. 16, 2009

(51) Int. Cl.
*A63B 21/005* (2006.01)

(52) U.S. Cl. ..... 482/5; 482/1; 482/4; 482/6

(58) Field of Classification Search ..... 482/1–9, 482/92–108, 900–903; 434/247
See application file for complete search history.

(56) References Cited

U.S. PATENT DOCUMENTS 5,476,428 A * 12/1995 Potash et al. ..... 482/5
5,993,356 A * 11/1999 Houston et al. ..... 482/4
6,050,920 A * 4/2000 Ehrenfried ..... 482/6

* cited by examiner

*Primary Examiner*—Glenn Richman
(74) *Attorney, Agent, or Firm*—Rosenberg, Klein & Lee

(57) ABSTRACT

A powered strength trainer includes: a motor of a load element being a DC or brushless motor; a controller, provided for users to adjust current and signal of the motor through a microcomputer control panel, and control the torque, vibration frequency and amplitude of the motor, such that the motor can produce a pulling force, a resistance and a vibration force at the same time, and a vibration waveform can be selected as needed, and a movement path sensor is provided for feeding back a position and determining a positive and negative rotation, and a curved load control is used for compensating a load current appropriately, and allowing users to obtain a smooth and real-world setting. A planar spiral spring drives a winch to rewind the steel wire to prevent the steel wire from falling out during a power disconnection or a power failure.

7 Claims, 8 Drawing Sheets

POWERED STRENGTH TRAINER

BACKGROUND OF THE INVENTION

1. Field of the Invention

The present invention relates to a powered strength trainer, in particular to a DC or brushless motor having a linear relation between current and torque to replace a traditional iron weight plate as a load element, and also having a vibration training function for controlling a curved load, compensating a load current, and preventing a rewound steel wire from falling off.

2. Description of the Related Art

Regardless of recreation, health or professional reasons, fitness exercise is an important part of our life. For example, strength trainers become very popular in developed countries in Europe and America, and iron weight plates are used to build up muscles, promote physiological functions, and maintaining a good health. Thus the iron weight plate is called a "weight strength trainer", whose structure is shown in FIG. 1. Such conventional strength trainer 10 is a weight machine that uses an iron weight plate 11 as a load of exercise, and patents of this sort were disclosed in U.S. Pat. Nos. 7,029,427, 5,833,585 and 4,478,411. However, the conventional loading methods still have the following shortcomings:

1. The iron weight plate 11 comes with a large volume and occupies much space. If a user needs to adjust the exercise load by increasing or decreasing the number and the weight of the load such as the iron weight plate 11, it will take much time and effort for the user to make the adjustment, and the user also has to stop the exercise to do so, and thus it is difficult to achieve the expected exercising effect.

2. The load such as the iron weight plate 11 is heavy and cannot be adjusted easily. Furthermore, an expected load acting as an index of the exercise cannot be achieved, and thus the exercising effect will be reduced substantially.

3. If the load such as the iron weight plate 11 is lifted by a transmission cable 12 and then released slowly, an annoying sound will be produced, and the irritating sound will cause discomfort to the exerciser.

4. The conventional strength trainer 10 is a weight load, and thus the load cannot be changed by setting an exercise curve, or vibration training cannot be preformed. As a result, the exercising function is limited.

5. Since the load cannot be adjusted during an exercise, such as the heartbeat rate exceeds a user's safe range, the load cannot be reduced automatically and immediately, and thus an over-exercise or exercise injury may occur easily.

Obviously, the conventional load device of the strength trainer 10 still has the following shortcomings and requires improvements.

In view of the aforementioned shortcomings of the prior art, the inventor of the present invention has provided an automatic load device for electric fitness equipments as disclosed in R.O.C. Pat. Publication No. 230359, wherein the torque of a DC motor is used to drive a steel wire to produce a rated tension in order to replace the conventional iron weight plates, and related technologies are disclosed in U.S. Pat. Nos. 5,020,794, 5,180,348, 4,979,733 and 4,678,184. However, the aforementioned prior arts still have the following drawbacks:

1. For a low load, the torque outputted by a DC motor is very low. Since the mechanical system inertia and mechanical loss offset a portion of the torque, the steel wire has no force exerted thereon and a very slow rewind speed. Thus, the speed is slower than that of the conventional iron weight plate, and users generally have poor response to the machines of this sort, and it is a pity of losing the original intention of exercises.

2. If there is a power disconnection or failure of the system when an exerciser is doing exercise, then the motor will lose its rewind capability, and the steel wire will be loosened. Thus, the steel wire will be slid from the spiral groove of the winch.

3. Due to the mechanical loss, the system inertia, and the acceleration of the transmission in the machine, the linear speed of the steel wire cannot match up with the user's exercise synchronously, and thus the machine of this sort is not good enough.

In view of the aforementioned issues, the inventor of the present invention provides a better solution and an improved design to overcome the shortcomings of the prior art and gives a better application to users.

SUMMARY OF THE INVENTION

It is a primary object of the invention to provide a powered strength trainer that uses the torque of a motor output shaft to replace a conventional iron weight plate. The invention has a simple and light structure, not only greatly reducing the weight and volume of the machine, but also creating no noise. The motor is used for producing a pulling force, a resistance and a vibration force, and several vibration waveforms are provided for the user's choice, and the frequency and the amplitude can be adjusted as required. These are what the conventional strength trainers have not achieved.

Another object of the present invention to provide an improved device to overcome the issue of having a loose rewound steel wire, wherein a planar spiral spring is installed at a rear end of a winch main shaft to produce a torque in a reverse direction and apply the torque to main shaft, and the torque is transmitted to a winch to provide a constant pulling force to a steel wire, and a roller bearing is installed at a front end of the main shaft and in a belt pulley to prevent driving a heavy motor armature while the main shaft is being rewound, so that the winch can rewind the steel wire quickly without the risk of falling out.

A further object of the present invention is to provide a powered strength trainer capable of detecting a user's heartbeat rate, and automatically reducing the load if the user's heartbeat exceeds a safe range, so that the heartbeat rate can be dropped to the safe range to assure the user's health.

Still another object of the present invention is to install an optical interrupt disk on a winch main shaft and link the optical interrupt disk to the winch main shaft, and install a pair of optical couplers at the periphery of the optical interrupt disk, and a movement path sensor, such that when the winch drives the optical interrupt disk, a pulse signal generated by the optical coupler is transmitted to a positive and negative rotation signal decoder in the controller to transmit positive and negative rotation signals to the microcomputer control panel for controlling a curved load and appropriately compensating a load current to provide a smooth and real-world setting to users.

DETAILED DESCRIPTION OF THE PREFERRED EMBODIMENT

Figure 1:
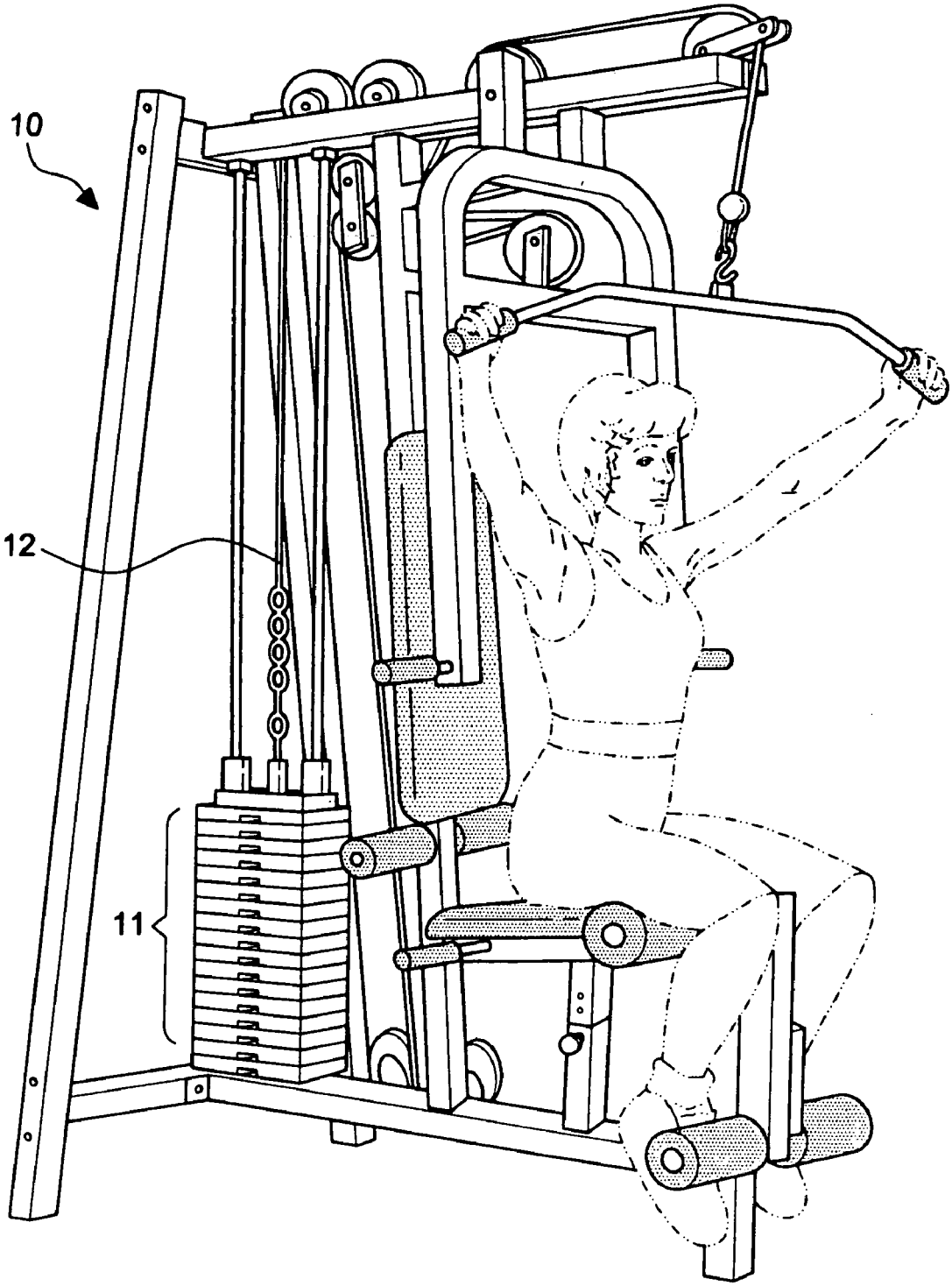
FIG.1 PRIOR ART
FIG. 1 is a schematic view of using a conventional strength trainer.
Figure 2:
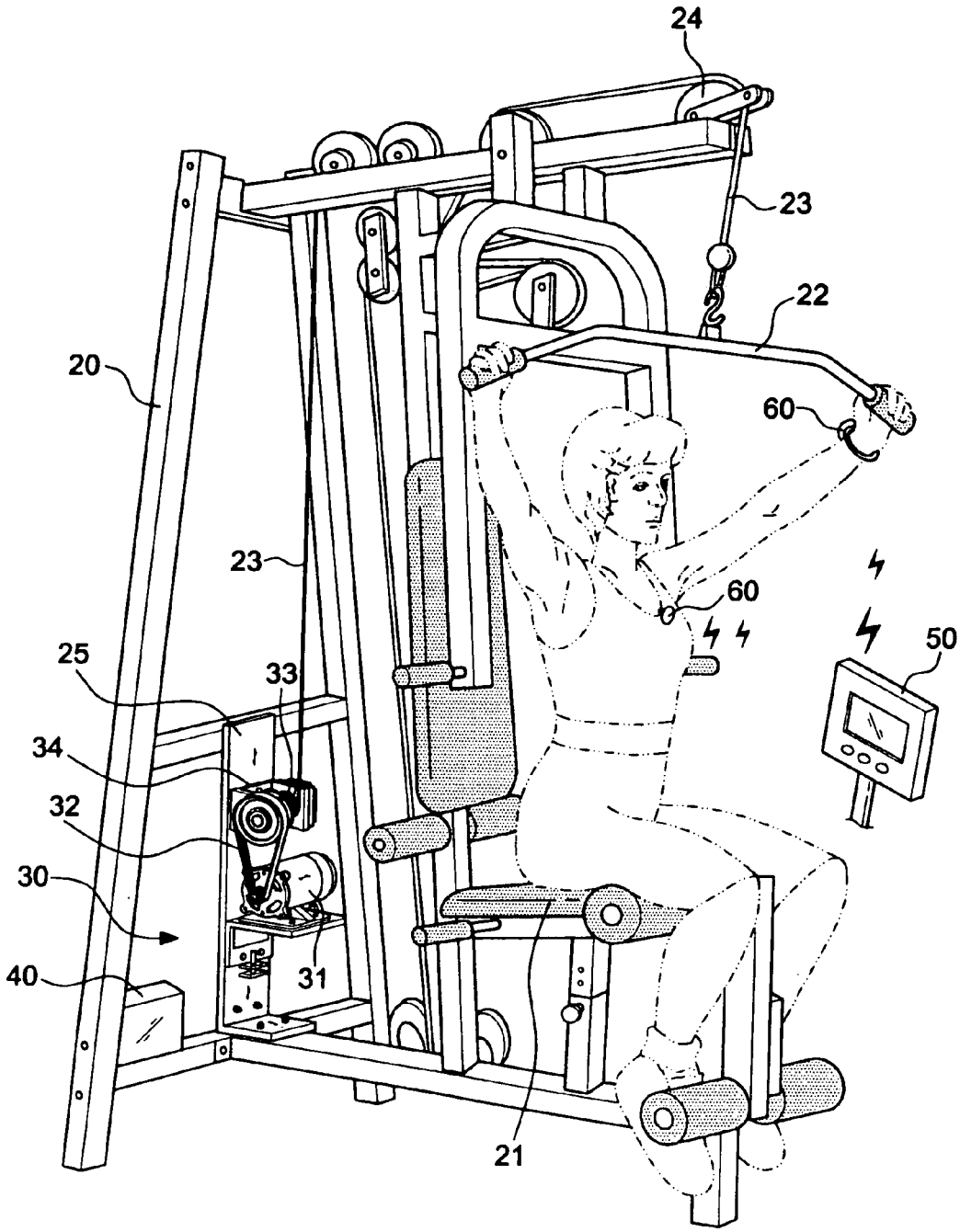
FIG. 2 is a perspective view of a preferred embodiment of the present invention.
Figure 3:
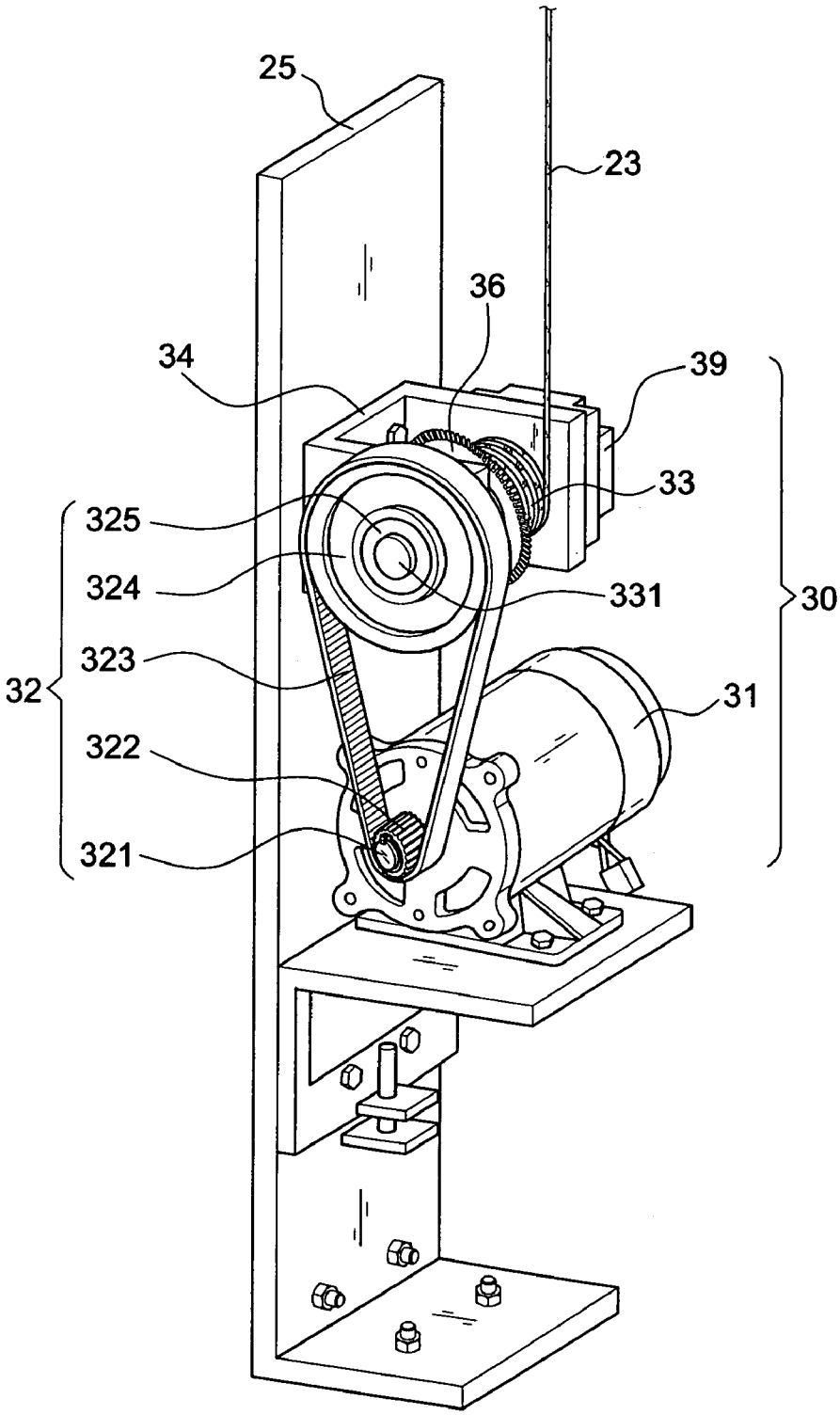
FIG. 3 is a perspective view of a load element of the present invention.
Figure 4:
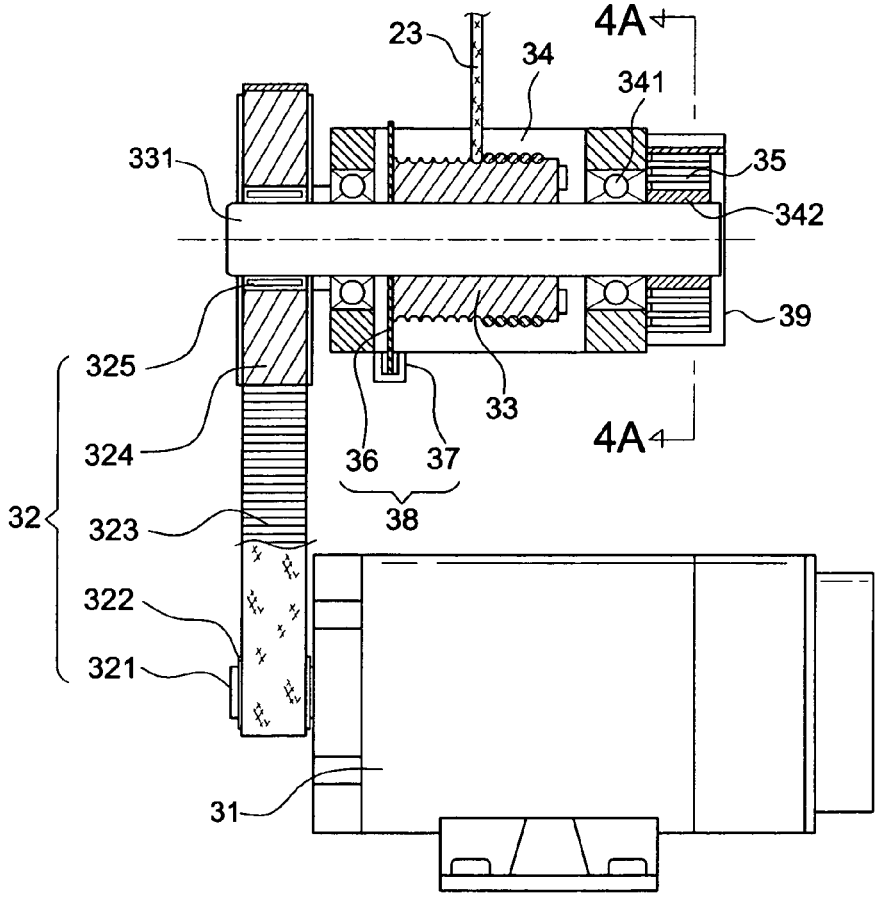
FIG. 4 is a cross-sectional view of a load element of the present invention.
Figure 4A:
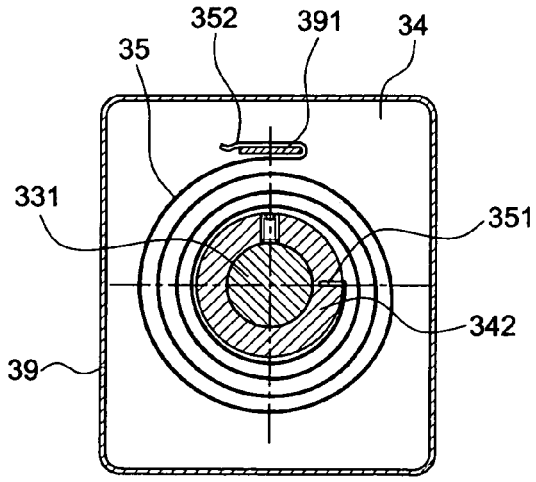
FIG. 4A is a cross-sectional view taken along the line 4A-4A as depicted in FIG. 4.
Figure 5:
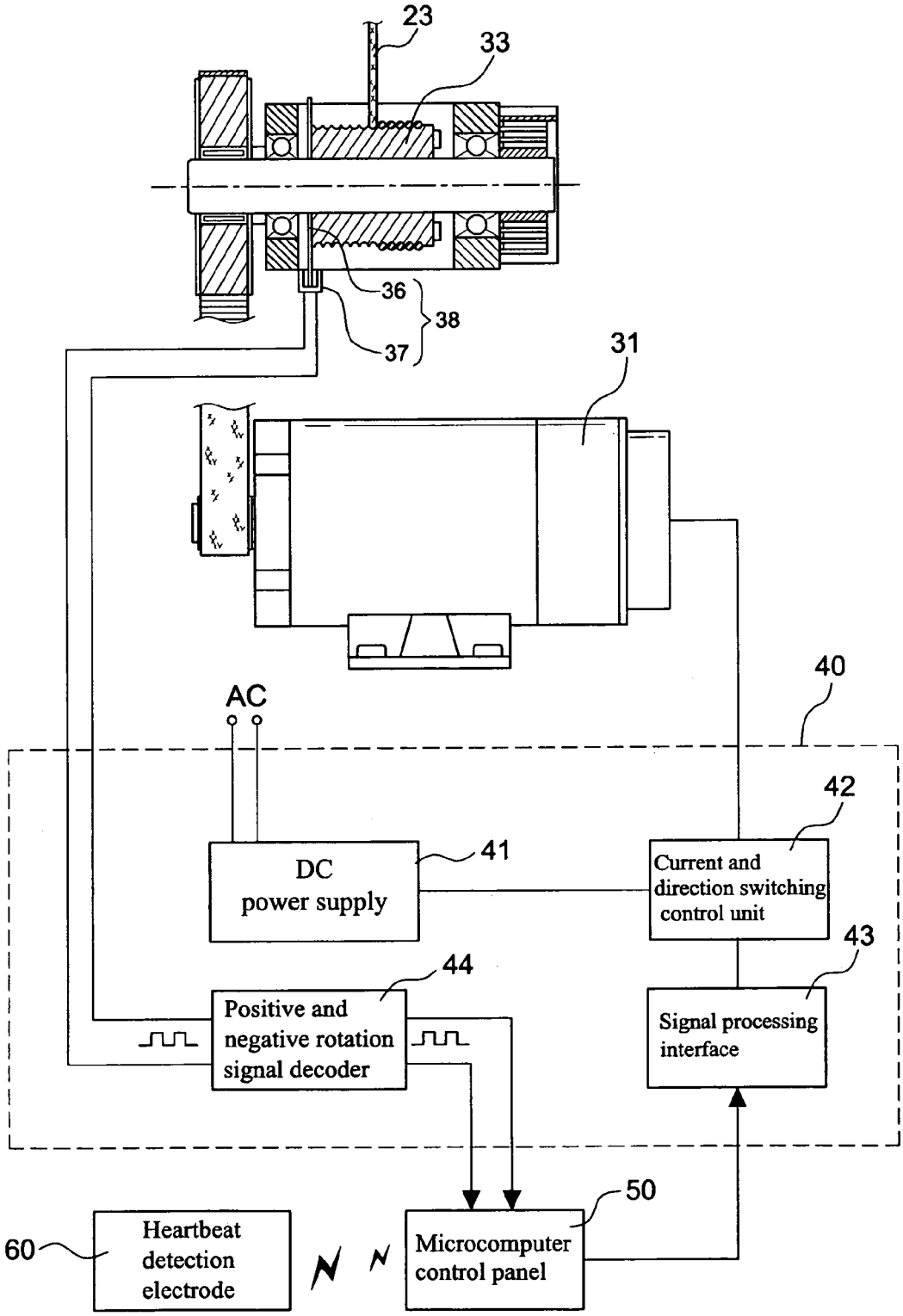
FIG. 5 is a schematic circuit diagram of a preferred embodiment of the present invention.

With reference to FIGS. 2 and 3 for a preferred embodiment of the present invention, the embodiment comprises:

a frame 20, having a seat 21 installed thereon, and a muscle extension element 22 connected to an end of a steel wire 23;

a load element 30, installed on the frame 20, and having a motor 31 and a transmission element 32 connected to a winch 33, and the winch 33 being connected to another end of the steel wire 23 through a guide pulley 24 and wound thereon; characterized in that the motor 31 of the load element 30 is a DC motor or a brushless motor, and the winch 33 is passed and extended to the bearing 341 by a linked main shaft 331 and then installed onto a positioning base 34 which is a U-shaped body and fixed onto an installation board 25.

The transmission element 32 includes a first belt pulley 322 installed at a motor output shaft 321, a second belt pulley 324 installed at a front end of the winch main shaft 331, a roller bearing 325 installed between the second belt pulley 324 and the main shaft 331, and a timing belt 323 connected to the first and second belt pulleys 322, 324.

A controller 40 is built in the control circuit, and a user can adjust the current and the signal transmitted to the motor 31 through a microcomputer control panel 50 for controlling the torque, the vibration frequency and the amplitude of the motor 31, such that the motor 31 produces a pulling force, a resistance and a vibration force simultaneously, and a vibration waveform can be selected as required.

A movement path sensor 38 includes an optical interrupt disk 36 disposed at the winch 33 and linked to the winch 33, and an optical coupler 37 installed at the periphery of the optical interrupt disk. In this preferred embodiment, the optical interrupt disk 36 is fixed to winch main shaft 331, and the optical coupler 37 is fixed to a U-shaped positioning base 34, such that if the winch 33 is driven by the steel wire 23 to rotate, the optical interrupt disk 36 will be rotated synchronously, and the pulse signal generated by the optical coupler 37 will be transmitted to the positive and negative rotation signal decoder 44 in the controller 40 for transmitting positive and negative rotation signals to the microcomputer control panel 50 respectively to control a curved load and appropriately compensate a load current.

A planar spiral spring 35 includes a cover 39 disposed at an external periphery of the planar spiral spring 35, and an internal end 351 of the planar spiral spring 35 is connected to a sleeve 342 at a rear end of the winch main shaft 331, and an external end of the planar spiral spring 35 forms a hook 352 fixed to a latch plate 391 on the external side of the positioning base, such that if the winch is driven by the steel wire 33 to rotate, the planar spiral spring 35 is forced and tightened. A torque in a reverse direction is applied to the main shaft 331, and transmitted to the winch 33 to provide a constant pulling force to the steel wire 23, and the roller bearing 325 in the second belt pulley 324 is separated from the second belt pulley 324 and will not drive the motor armature when the main shaft 331 rewinds. As a result, the winch 33 can rewind the steel wire 23 quickly. In this preferred embodiment, the latch plate 391 is connected and fixed to an internal side of the cover 39, but the present invention is not limited to such arrangement only.

A control circuit of the controller 40 includes a DC power supply 41, a current and direction switching control unit 42, a signal processing interface 43 and a positive and negative rotation signal decoder 44.

Since the muscle extension element 22 drives the optical interrupt disk 36 through the winch 33, pulses generated by a pair of optical couplers 37 are transmitted to the positive and negative rotation signal decoder 44, and the positive and negative rotation signals are transmitted to the microcomputer control panel 50 respectively. On one hand, a movement path is shown on a display of the microcomputer control panel 50. On the other hand, the positive and negative rotation pulse signal is used for calculating a dynamic mechanical loss to appropriately compensate the loss.

The aforementioned microcomputer control panel 50 as shown in FIG. 2 is installed on a lateral side of the machine and at a position to facilitate users to make adjustments. The controller 40 is electrically coupled to the microcomputer control panel 50, so that a user can enter data or an instruction from the microcomputer control panel 50, and the controller 40 can control the current supplied to the motor 31 according to the signals.

The invention has a simple and light structure, not only greatly reducing the weight and volume of the machine, but also creating no noise and allowing computerized adjustments. The motor is used for producing a continuous, smooth and variable resistance to provide a comfortable use and minimize exercise injuries.

The motor 31 and positioning base 34 is fixed on the installation board 25 of the frame 20, without any particular limitation of its form.

Either the microcomputer control panel 50 or the controller 40 includes a user's heartbeat rate signal transmitted by a heartbeat detector 60. The heartbeat detector 60 can be a detector tied to a user's chest or a heart rate monitor worn at a user's wrist, and related products were disclosed in U.S. Pat. Nos. 4,409,983, 4,224,948, 4,120,269 and 5,807,267, and thus will not be described here again.

More importantly, the motor 31 of the present invention is a DC motor or a brushless motor, and thus the motor 31 can produce a vibration force, in addition to a pulling force and a resistance. Based on scientific researches, a combination of vibration stimulation and resistance training can improve muscular force and power.

Figure 6A:
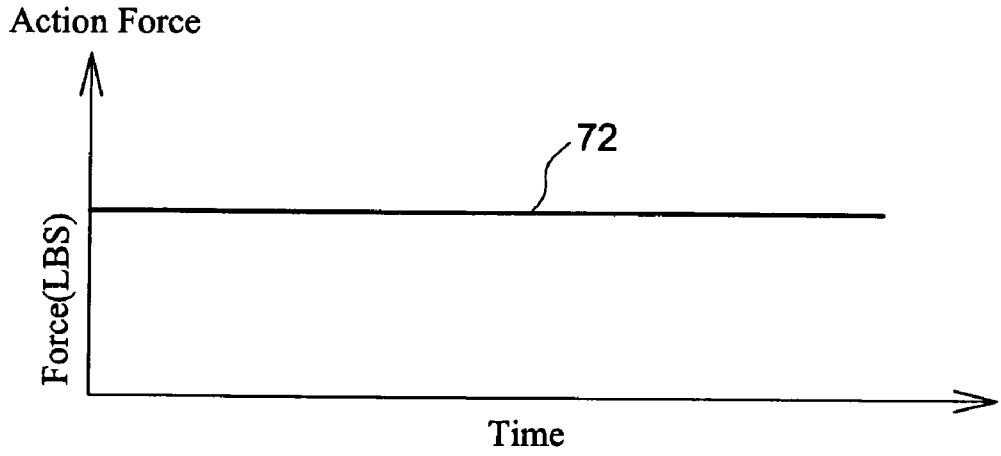
FIG.6A PRIOR ART
FIG. 6A is a graph of exercise time versus force of a conventional strength trainer.
Figure 6B:
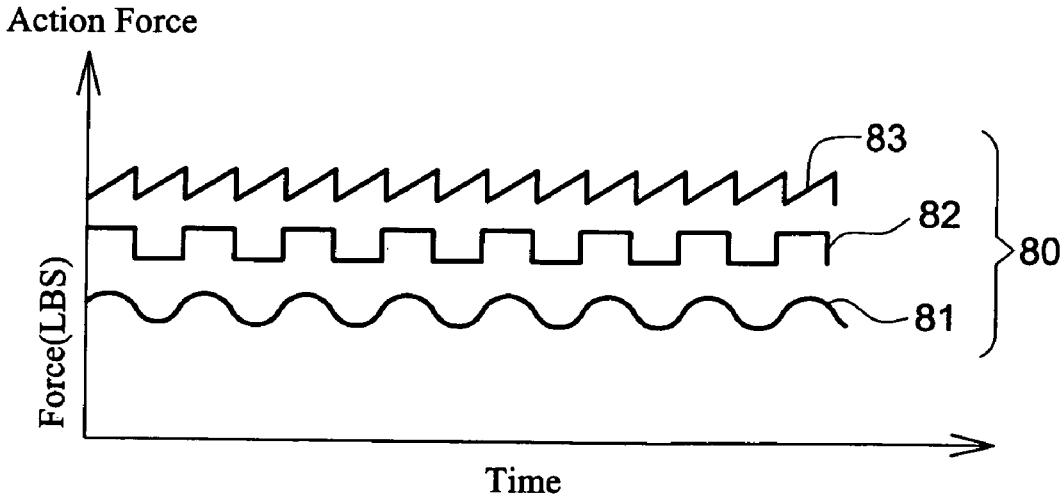
FIG. 6B is a graph of exercise time versus force of a strength trainer in accordance with the present invention.

Therefore, the present invention has a first unique function used in a vibration training to build up muscles for athletes, reduce weight for women and provide therapies for the elderly. With reference to FIGS. 6A and 6B for a comparison between a conventional strength trainer and the present invention, a vibration waveform 80 produced by the motor 31 of the present invention is a sine wave 81, a square wave 82 or a sawtooth wave 83, etc, and this is what a conventional weight strength trainer cannot achieve.

Figure 7A:
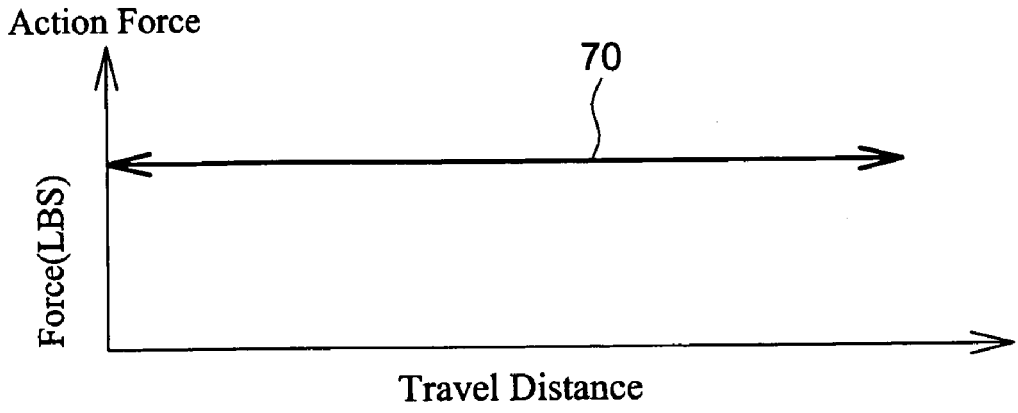
FIG.7A PRIOR ART
FIG. 7A is a graph of travel distance versus force of a conventional strength trainer.
Figure 7B:
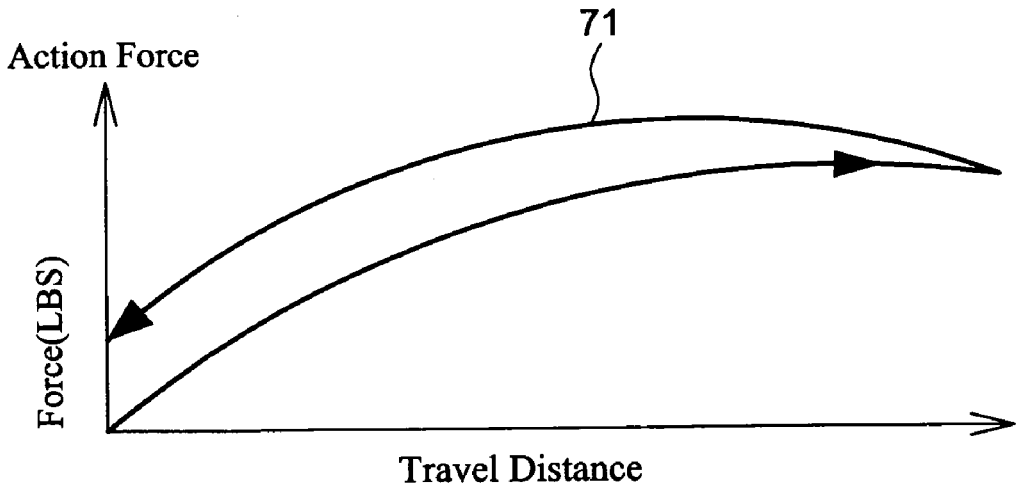
FIG. 7B is a graph of travel distance versus force of a strength trainer in accordance with the present invention.

The second unique function of the present invention is its variable pulling force and resistance as shown in the comparison tables of FIGS. 7A and 7B. The pulling force and resistance of the motion can be increased or decreased smoothly and gradually according to a curve 71 preset by the microcomputer control panel 50. This function can greatly reduce the risk of exercise injuries of the users, particularly physical therapy patients, the elderly and women. This is what a conventional weight strength trainer cannot achieve.

Figure 8A:
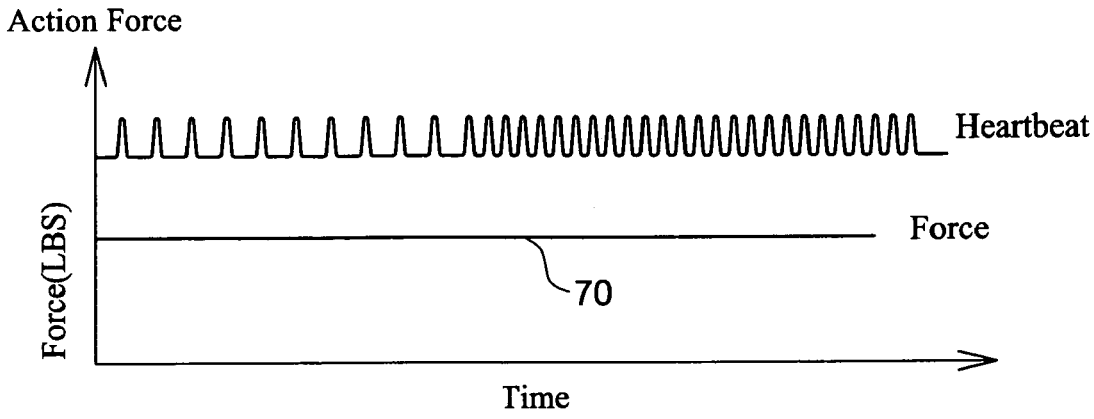
FIG.8A PRIOR ART
FIG. 8A is a graph of heartbeat rate versus force of a conventional strength trainer.
Figure 8B:
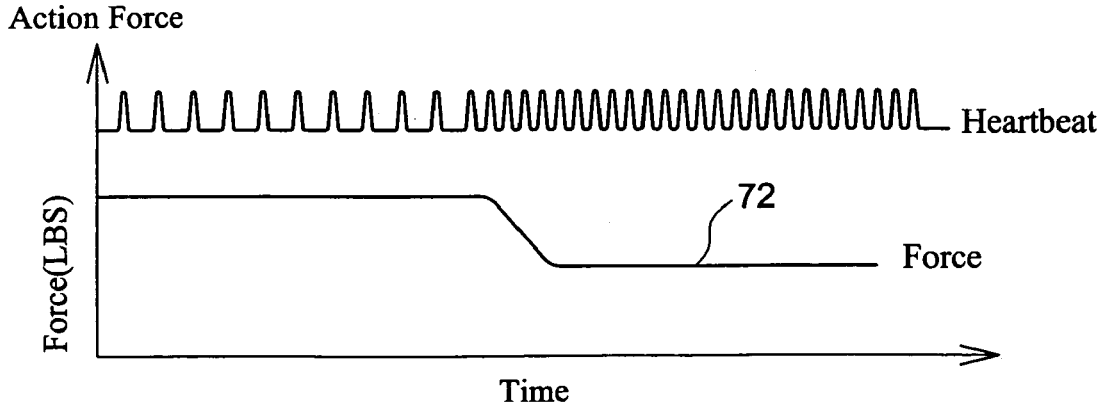
FIG. 8B is a graph of heartbeat rate versus force of a strength trainer in accordance with the present invention.

The present invention has a third unique function of controlling a load action force according to an exerciser's heartbeat rate. If the exerciser's heartbeat exceeds a safe range, the microcomputer control panel 50 will reduce the load action force automatically as shown in FIG. 8B to reduce the heartbeat rate to the safe range gradually, or the exerciser's exercising conditions are monitored and recorded by a doctor or a trainer via a network, such that emergency can be discovered and handled timely. This is what a conventional weight strength trainer cannot accomplish. With reference to FIG. 8A for a graph of heartbeat versus action force, the load action 70 will remain unchanged even if the heartbeat rate exceeds the safe range, and thus the conventional muscle trainer may bring risks and even fatal dangers to physical therapy patients and heart disease patients.

The present invention makes use of a linear relation between the current and the torque of a motor to replace a traditional iron weight plate as the load element, and provides a vibration training function as well. In addition, the present invention can control a curved load and appropriately compensate a load current. The present invention also overcomes the shortcomings of the prior art by preventing the steel wire from being loosened or falling off during a power disconnection or a power failure.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A powered strength trainer, comprising:

a frame, having a seat installed thereon, and a muscle extension element coupled to an end of a steel wire;

a load element, installed on the frame, and having a motor, and coupled with a winch by a transmission element, and the winch being provided for coupling another end of the steel wire and coiled thereon; characterized in that:

the motor of the load element is a direct current (DC) motor or a brushless motor, and the winch installed on a positioning base after the winch is passed and extended to a bearing by a main shaft linked with the winch;

the transmission element includes a first belt pulley of a motor output shaft, a second belt pulley installed at a front end of the winch main shaft, a roller bearing installed between the second belt pulley and the main shaft, and a timing belt connected to the first and second belt pulleys;

a controller with a built-in control circuit includes a DC power supply, a current and direction switching control unit, a signal processing interface and a positive and negative rotation signal decoder; and a user adjusts the current and signal transmitted to the motor through a microcomputer control panel, for controlling a torque, a vibration frequency and an amplitude of the motor, such that the motor produces a pulling force, a resistance and a vibration force simultaneously, and a vibration waveform can be selected as required;

a movement path sensor, including an optical interrupt disk installed at a lateral side of the winch and linked to the winch, and a pair of optical couplers installed at the periphery of the optical interrupt disk, such that if the steel wire drives the winch to rotate, the optical interrupt disk will be rotated synchronously, and a pulse signal generated by the optical coupler will be sent to a positive and negative rotation signal decoder in the controller for transmitting a positive and negative rotation signal to the microcomputer control panel, and performing a curved load control and appropriately compensating a load current; and a planar spiral spring, with an internal end coupled to a sleeve at a rear end of the winch main shaft, and forming a hook at an external end, such that the hook is fixed to a latch plate on an external side of the positioning base, and if the winch is driven and rotated by the steel wire, the planar spiral spring will be forced and tightened to apply a torque in a reverse direction onto the main shaft, and transmit the torque to the winch to provide a constant pulling force to the steel wire, and the roller bearing in the second belt pulley will be separated from the second belt pulley without driving the motor armature when the main shaft is rewound, and the winch can rewind the steel wire quickly during a power disconnection.

2. The powered strength trainer of claim 1, wherein the microcomputer control panel is installed on the frame or the periphery of the frame.

3. The powered strength trainer of claim 1, wherein the microcomputer control panel receives a user's heartbeat rate signal transmitted from a heartbeat detector.

4. The powered strength trainer of claim 3, wherein the heartbeat detector is installed at a user's chest and wrist.

5. The powered strength trainer of claim 1, wherein the vibration waveform produced by the motor is one selected from the collection of a sine wave, a square wave and a sawtooth wave.

6. The powered strength trainer of claim 1, wherein the positioning base of the winch main shaft is a U-shaped body; and an optical interrupt disk fixed to the winch main shaft, and a pair of optical couplers fixed onto the U-shaped positioning base.

7. The powered strength trainer of claim 1, further comprising a cover installed at the external periphery of the planar spiral spring, and the latch plate is coupled and fixed to an internal side of the cover.

* * * * *